US010890293B2

(12) United States Patent
Gustafson

(10) Patent No.: US 10,890,293 B2
(45) Date of Patent: Jan. 12, 2021

(54) CRYOGENIC FLUID TRANSFER SYSTEM AND METHOD

(71) Applicant: Chart Inc., Ball Ground, GA (US)

(72) Inventor: Erik Gustafson, Woodstock, GA (US)

(73) Assignee: Chart Inc., Ball Ground, GA (US)

( * ) Notice: Subject to any disclaimer, the term of this patent is extended or adjusted under 35 U.S.C. 154(b) by 0 days.

(21) Appl. No.: 16/293,985

(22) Filed: Mar. 6, 2019

(65) Prior Publication Data

US 2019/0277450 A1 Sep. 12, 2019

Related U.S. Application Data

(60) Provisional application No. 62/639,311, filed on Mar. 6, 2018.

(51) Int. Cl.
*F17C 7/02* (2006.01)
*F17C 5/02* (2006.01)
(Continued)

(52) U.S. Cl.
CPC ..... *F17C 7/02* (2013.01); *F17C 5/00* (2013.01); *F17C 5/02* (2013.01); *F17C 7/00* (2013.01); *F17C 2205/0367* (2013.01); *F17C 2221/014* (2013.01); *F17C 2221/033* (2013.01); *F17C 2223/0161* (2013.01); *F17C 2223/033* (2013.01); *F17C 2225/0161* (2013.01); *F17C 2225/033* (2013.01); *F17C 2227/0107* (2013.01); *F17C 2227/0157* (2013.01);
(Continued)

(58) Field of Classification Search
CPC ..... F17C 7/02; F17C 7/00; F17C 5/02; F17C 5/00
See application file for complete search history.

(56) References Cited

U.S. PATENT DOCUMENTS

2008/0078188 A1 4/2008 Matheoud et al.
2008/0148754 A1* 6/2008 Snytsar ..... F01K 25/10 62/259.2
(Continued)

FOREIGN PATENT DOCUMENTS

WO 2015012883 A1 1/2015
WO 2016016647 A1 2/2016

OTHER PUBLICATIONS

International Search Report and Written Opinion of the European Patent Office for International Application No. PCT/US2019/020908, dated Jun. 18, 2019, 13 pages.

*Primary Examiner* — Kevin L Lee
(74) *Attorney, Agent, or Firm* — Cook Alex Ltd.; R. Blake Johnston

(57) ABSTRACT

A system for transferring cryogenic fluid from a dispensing tank to a receiving tank is disclosed. The dispensing tank stores a supply of cryogenic liquid with a dispensing tank headspace above the liquid. A compressor has an inlet connected to the headspace of a receiving tank and an outlet connected to the headspace of the dispensing tank. A liquid transfer line is in fluid communication with the liquid side of the dispensing tank and the receiving tank. Cryogenic liquid is transferred from the dispensing tank to the receiving tank when the compressor is activated so as to transfer vapor from the headspace of the receiving tank to the headspace of the dispensing tank to create a pressure differential between the dispensing and receiving tanks.

23 Claims, 1 Drawing Sheet

(51) Int. Cl.
*F17C 5/00* (2006.01)
*F17C 7/00* (2006.01)

(52) U.S. Cl.
CPC . *F17C 2227/0311* (2013.01); *F17C 2227/042* (2013.01); *F17C 2250/0408* (2013.01); *F17C 2260/025* (2013.01); *F17C 2260/036* (2013.01); *F17C 2265/065* (2013.01); *F17C 2270/0139* (2013.01)

(56) References Cited

U.S. PATENT DOCUMENTS

| | | | | |
|---|---|---|---|---|
| 2015/0027136 | A1* | 1/2015 | Desjardins et al. ..... | F17O 7/02 62/50.7 |
| 2017/0191619 | A1 | 7/2017 | Snyder et al. | |

* cited by examiner

CRYOGENIC FLUID TRANSFER SYSTEM AND METHOD

CLAIM OF PRIORITY

The present application claims the benefit of and priority to U.S. Provisional Patent Application No. 62/639,311, filed Mar. 6, 2018, the contents of which are hereby incorporated by reference.

FIELD OF THE INVENTION

The present disclosure relates generally to cryogenic fluid transfer systems and, more specifically, to a lossless or nearly lossless, closed-loop cryogenic fluid transfer system and method that incorporates a compressor.

BACKGROUND

Typically, cryogenic fluids are stored in pressure vessels so that, as the vessels are heated, the warmed and partly vaporized cryogenic fluids therein pressurize the containers without loss of product. There are situations and applications, however, where one would desire to transfer all or a portion of the cryogenic fluid from one pressure vessel to another. Examples include filling portable cryogenic cylinders from a bulk cryogenic tank, filling a vehicle-mounted liquefied natural gas (LNG) fuel tank from a fuel station bulk tank, or transferring fluid from a first cylinder to a second cylinder to effect repairs on the first cylinder.

A variety of prior art methods are commonly used for transferring cryogenic fluid from one vessel to another. If the fluid being transferred is relatively inexpensive (such as liquid nitrogen), transfer is usually effected by a "vent fill" method wherein a single hose connects the liquid phase of the dispensing tank to the receiving tank. When the receiving tank's vent is opened to the atmosphere, liquid can then transfer from the dispensing tank to the receiving tank, as the vapor pressure in the headspace of the dispensing tank "pushes" the liquid phase out of the dispensing tank. There is inherent loss in this transfer, however, since the receiving tank must vent vapor to remain at a pressure that is lower than the pressure of the dispensing tank. Automated systems have been designed to minimize these transfer losses by automatically venting the least amount of vapor possible to achieve a fill. An example of such a system is the Lo-Loss Liquid Cylinder Filling System available from Chart Industries, Inc. of Ball Ground, Ga. Systems and methods such as this, however, can only minimize the losses to the minimum allowed by the laws of physics, and usually still incur losses or around 5%.

More expensive fluids (such as liquid argon or LNG) require more sophisticated (and expensive) solutions to effect low- or no-loss transfers. The simplest solution is for the dispensing tank to build and maintain a sufficient head pressure to fill the receiving tank without venting. This can be done with standard pressure building circuits well-known to those in the art including, but not limited to, those that vaporize liquid from the liquid side of the tank using one or more heat exchanger(s) and direct the resulting vapor to the headspace of the tank.

In the case where the dispensing tank is a bulk storage tank, however, it may be cost-prohibitive to construct a large volume high-pressure tank. Furthermore, it is commonly found that the receiving tank (often a portable cylinder) is of a higher working pressure than the bulk storage tank. Cryogenic liquid pumps can be used to transfer liquid from the dispensing tank to the receiving tank in such situations, though the pumps may be quite expensive.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a cryogenic fluid transfer system includes a dispensing tank having a dispensing tank headspace, where the dispensing tank is configured to store a supply of cryogenic liquid with the dispensing tank headspace above the supply of cryogenic liquid. A receiving tank has a receiving tank headspace. A compressor has an inlet and an outlet. A compressor inlet line is in fluid communication with the receiving tank headspace and the compressor inlet. A compressor outlet line is in fluid communication with the compressor outlet and the headspace of the dispensing tank. A liquid transfer line is in fluid communication with the dispensing tank and the receiving tank and is configured to transfer cryogenic liquid from the dispensing tank to the receiving tank when the compressor is activated so as to transfer vapor from the headspace of the receiving tank to the headspace of the dispensing tank to create a pressure differential between the dispensing and receiving tanks.

In another aspect, a cryogenic fluid transfer system includes a dispensing tank having a dispensing tank headspace and is configured to store a supply of cryogenic liquid with the dispensing tank headspace above the supply of cryogenic liquid. A receiving tank has a receiving tank headspace. A compressor has an inlet and an outlet. A compressor inlet line is in fluid communication with the receiving tank headspace and the compressor inlet. A compressor outlet line is in fluid communication with the compressor outlet and the headspace of the dispensing tank so that when the compressor is activated, vapor from the headspace of the receiving tank flows to the headspace of the dispensing tank so as to create a pressure differential between the dispensing and receiving tanks. A liquid transfer line is in fluid communication with the dispensing tank and the receiving tank and configured to transfer cryogenic liquid from the dispensing tank to the receiving tank due to the pressure differential between the dispensing and receiving tanks.

In another aspect, a method for transferring a cryogenic liquid from a dispensing tank to a receiving tank includes the steps of withdrawing vapor from a headspace of the receiving tank and delivering it to a headspace of the dispensing tank so that a differential pressure is created between the dispensing and receiving tanks. The liquid side of the dispensing tank is placed in fluid communication with the receiving tank so that cryogenic liquid is driven from the dispensing tank to the receiving tank by the differential pressure.

DETAILED DESCRIPTION OF EMBODIMENTS

Embodiments of the disclosure provide a fluid transfer system and method that utilizes a compressor to move vapor from the receiving tank to the dispensing tank, thereby simultaneously decreasing the receiving tank's pressure and increasing the dispensing tank's pressure so that cryogenic liquid may flow freely though a separate connecting line.

Figure 1:
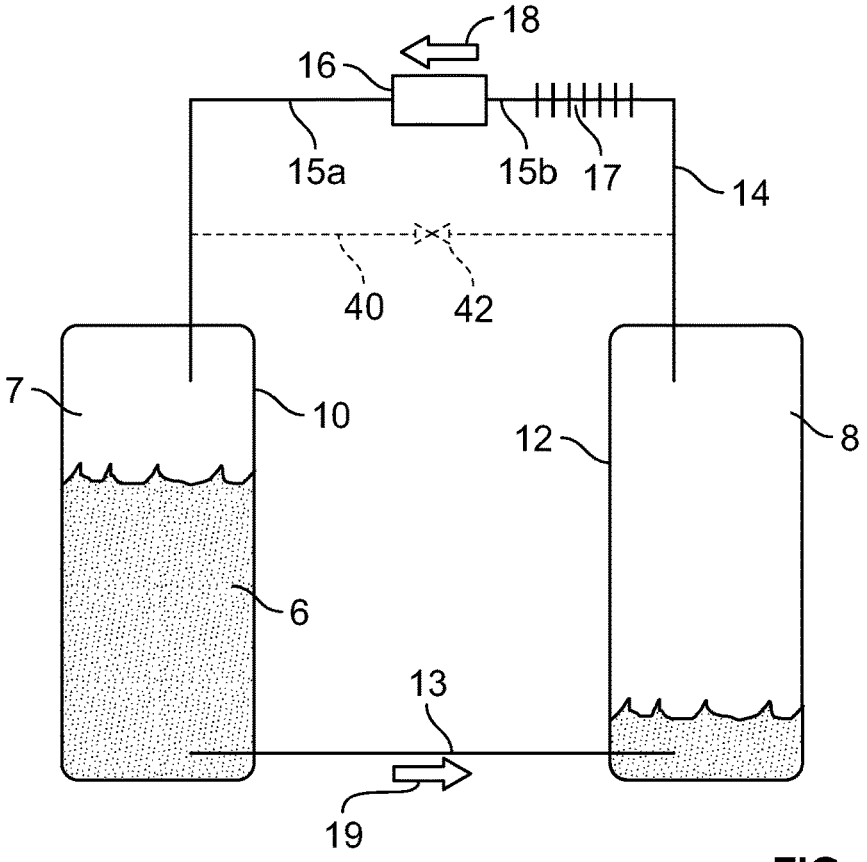
FIG. 1 is a schematic view of a first embodiment of the cryogenic fluid transfer system of the disclosure.

FIG. 1 depicts a first embodiment of the cryogenic fluid transfer system of the disclosure that is able to transfer cryogenic liquid 6 from a dispensing tank 10 to a receiving tank 12. The dispensing tank 10 includes a headspace 7 above the cryogenic liquid, while the receiving tank 12 includes a headspace 8. As used herein, the term "headspace" means the same thing as a vapor space within tank 10 or 12.

A liquid transfer line 13 connects the liquid side or liquid space of the dispensing tank 10 to the liquid side or liquid space of receiving tank 12. It is to be understood that portions of the dispensing and receiving tank interiors may be either vapor or liquid spaces, depending on the liquid levels in the tanks.

A heat exchanger inlet line 14 connects the headspace of receiving tank 12 to the inlet of a heat exchanger 17. A compressor inlet line 15*b* extends between the outlet of the heat exchanger 17 and the inlet of a compressor 16, while a compressor outlet line 15*a* extends between the outlet of the compressor 16 and the headspace of dispensing tank 10.

An explanation of how the transfer system of FIG. 1 operates is as follows.

With tanks 10 and 12 starting at equal pressures, and at least dispensing tank 10 containing a supply of cryogenic liquid 6, compressor 16 is powered on. Compressor 16 creates a differential pressure between the two tanks 10 and 12 by drawing vapor from the headspace 8 of receiving tank 12 through line 14 and warming it in heat exchanger 17. The compressor 16 receives the warmed vapor via line 15*b* and pushes it via line 15*a* to the headspace 7 of dispensing tank 10, as indicated by arrow 18. The resulting differential pressure between tanks 10 and 12 causes the cryogenic liquid 6 to flow from dispensing tank 10 to receiving tank 12 through liquid line 13, as indicated by arrow 19. The transfer occurs until the compressor 16 is is turned off or all of the liquid has been removed from dispensing tank 10.

The system of FIG. 1 may optionally be provided with feedback control so that operation of the compressor 16 may be automated. As an example only, a liquid level sensor may be provided for the dispensing tank 10 and connected to a controller that is configured to deactivate the compressor 16 when the liquid level within the dispensing tank 10 drops below a predetermined level. As another example, the receiving tank 12 may be provided with a liquid level sensor that is connected to the controller, where the controller is configured to deactivate the compressor 16 when the liquid level in the receiving tank rises above a predetermined level. Other types of sensors and feedback arrangements known in the art may alternatively be employed.

It should be noted that heat exchanger 17 of FIG. 1 may be omitted if a compressor 16 that is capable of handling cryogenic temperature vapors is used. However, since cold vapor is denser than warm vapor, the rate of transfer will be slowed in such an embodiment. Furthermore, while an ambient air heat exchanger is illustrated in FIG. 1, alternative types of heat exchangers known in the art may be used in the system of FIG. 1. Examples of the types of heat exchangers that may be used include, but are not limited to, electric, shell and tube and/or flat plate heat exchangers.

Figure 2:
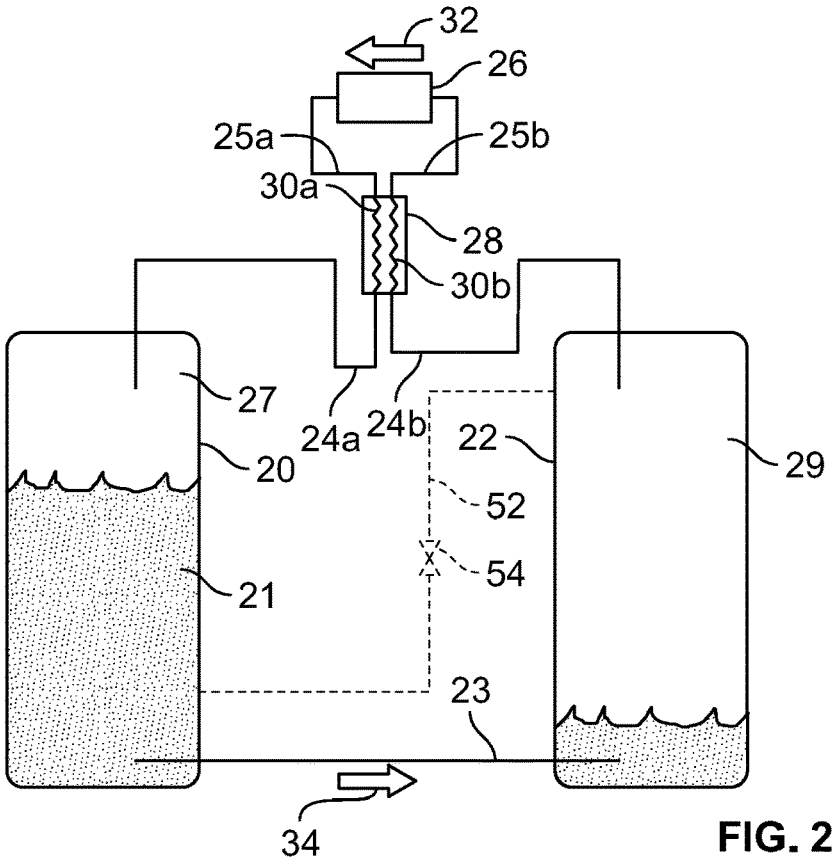
FIG. 2 is a schematic view of a second embodiment of the cryogenic fluid transfer system of the disclosure.

FIG. 2 shows an alternative embodiment of the cryogenic fluid transfer system of the disclosure that is able to transfer cryogenic liquid 21 from dispensing tank 20 to receiving tank 22. The dispensing tank 20 includes a headspace 27 above the cryogenic liquid, while the receiving tank 22 includes a headspace 29.

A liquid transfer line 23 connects the liquid side or liquid space of the dispensing tank 20 to the liquid side or liquid space of receiving tank 22. It is to be understood that portions of the dispensing and receiving tank interiors may be either vapor or liquid spaces, depending on the liquid levels in the tanks.

A heat exchanger inlet line 24*b* connects the headspace of receiving tank 22 to the inlet of a heat exchanger passage 30*b*. A compressor inlet line 25*b* extends between the outlet of the passage 30*b* of the heat exchanger 28 and the inlet of the compressor 26. A compressor outlet line 25*a* leads from the outlet of the compressor to the inlet of passage 30*a* of the heat exchanger 28. A heat exchanger outlet line 24*a* leads from the outlet of heat exchanger passage 30*a* to the headspace 27 of dispensing tank 20.

The system of FIG. 2 is provided with a two-pass heat exchanger 28, including passages 30*a* and 30*b*, which are in heat exchange relationship with one another, in place of the single pass heat exchanger 17 of FIG. 1. Two-pass heat exchanger 28 minimizes the amount of heat added to the overall system. Rather than relying on external heat to warm the vapor from the headspace 29 of the receiving tank 22 before the compressor as heat exchanger 17 of FIG. 1 does, two-pass heat exchanger 28 uses the heat of compression present in the fluid flowing through heat exchanger passage 30*a* to warm the incoming cold vapor in passage 30*b* and conserve heat input. This may be desirable in cases where heat input is a concern.

With the exception of the heat exchanger 28, the transfer system of FIG. 2 operates in the same manner as the transfer system of FIG. 1. More specifically, with tanks 20 and 22 starting at equal pressures, and at least dispensing tank 20 containing a supply of cryogenic liquid 21, compressor 26 is powered on. Compressor 26 creates a differential pressure between the two tanks by drawing vapor from the headspace 29 of receiving tank 22 through line 24*b* and warming it in passage 30*b* of heat exchanger 28 before receiving the vapor via line 25*b*. The compressor then pushes the vapor through line 25*a*, heat exchanger passage 30*a* and line 24*a*, to the headspace 27 of dispensing tank 20, as indicated by arrow 32. The resulting differential pressure between tanks 20 and 22 causes the cryogenic liquid 21 to flow from dispensing tank 20 to receiving tank 22 through liquid line 23, as indicated by arrow 34. The transfer occurs until the compressor 26 is turned off or all of the liquid has been removed from dispensing tank 20.

As with the system of FIG. 1, the system of FIG. 2 may optionally be provided with feedback control so that operation of the compressor 26 may be automated. As an example only, a liquid level sensor may be provided for the dispensing tank 20 and connected to a controller that is configured to turn the compressor 26 off when the liquid level within the dispensing tank 20 drops below a predetermined level. As another example, the receiving tank 22 may be provided with a liquid level sensor that is connected to the controller, where the controller is configured to deactivate the compressor 26 when the liquid level in the receiving tank rises above a predetermined level. Other types of sensors and feedback arrangements known in the art may alternatively be employed.

Additional embodiments of the transfer system of the disclosure may include additional plumbing lines or valving to allow additional user benefits.

One example is a bypass line that is equipped with a valve, indicated at 40 and 42, respectively, in FIG. 1, around the compressor. The pressures of tanks 10 and 12 may be equalized by opening valve 42. The bypass line may bypass both the compressor and the heat exchanger (as illustrated in FIG. 1) or it may bypass only the compressor (i.e. by connecting between lines 15*a* and 15*b*).

As another example, with reference to FIG. 2, an equalization line 52, equipped with valve 54, allows the vapor of the receiving tank, when the valve 54 is open, to flow into the liquid space of the dispensing tank to keep the overall system pressure from rising above a predetermined level.

Valves 42 (FIG. 1) and 54 (FIG. 2) may optionally be automated using a feedback control system where the valves are controlled by a controller that senses the pressure of the dispensing and/or receiving tanks.

These and other modifications are possible, but do not detract or alter the general concept of this disclosure, which is the closed-loop transfer system utilizing a compressor acting on the vapor flowing between a dispensing and receiving tank.

As an example only, the systems of the disclosure may be used to fill a bulk cryogenic tank from a cryogenic transport trailer. An example of a cryogen in such an application includes, but is not limited to, liquid hydrogen. As another example, the systems of the disclosure may be used to fill liquid hydrogen fuel tanks on vehicles at a liquid hydrogen refueling station.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A cryogenic fluid transfer system comprising:

a. a dispensing tank having a dispensing tank headspace, said dispensing tank configured to store a supply of cryogenic liquid with the dispensing tank headspace above the supply of cryogenic liquid;

b. a receiving tank having a receiving tank headspace;

c. a compressor having an inlet and an outlet;

d. a compressor inlet line in fluid communication with the receiving tank headspace and the compressor inlet;

e. a compressor outlet line in fluid communication with the compressor outlet and the headspace of the dispensing tank;

f. a liquid transfer line in fluid communication with the dispensing tank and the receiving tank and configured to transfer cryogenic liquid from the dispensing tank to the receiving tank when the compressor is activated so as to transfer vapor from the headspace of the receiving tank to the headspace of the dispensing tank to create a pressure differential between the dispensing and receiving tanks; and g. a compressor bypass line selectively in fluid communication with the headspaces of the dispensing and receiving tanks for equalizing pressures of the dispensing and receiving tanks.

2. The transfer system of claim 1 further comprising a heat exchanger having an inlet in fluid communication with the headspace of the receiving tank and an outlet in fluid communication with the inlet of the compressor, said heat exchanger configured so that vapor from the headspace of the receiving tank is warmed in the heat exchanger before traveling to the inlet of the compressor.

3. The transfer system of claim 2 wherein the heat exchanger is an ambient air heat exchanger.

4. The transfer system of claim 1 further comprising a sensor configured to sense a liquid level within the dispensing tank, said sensor in communication with a controller that is configured to deactivate the compressor when a liquid level within the dispensing tank drops below a predetermined level.

5. The transfer system of claim 1 further comprising a sensor configured to sense a liquid level within the receiving tank, said sensor in communication with a controller that is configured to deactivate the compressor when a liquid level within the receiving tank exceeds a predetermined level.

6. A cryogenic fluid transfer system comprising:

a. a dispensing tank having a dispensing tank headspace, said dispensing tank configured to store a supply of cryogenic liquid with the dispensing tank headspace above the supply of cryogenic liquid;

b. a receiving tank having a receiving tank headspace;

c. a compressor having an inlet and an outlet;

d. a compressor inlet line in fluid communication with the receiving tank headspace and the compressor inlet;

e. a compressor outlet line in fluid communication with the compressor outlet and the headspace of the dispensing tank;

f. a liquid transfer line in fluid communication with the dispensing tank and the receiving tank and configured to transfer cryogenic liquid from the dispensing tank to the receiving tank when the compressor is activated so as to transfer vapor from the headspace of the receiving tank to the headspace of the dispensing tank to create a pressure differential between the dispensing and receiving tanks; and g. a heat exchanger configured so that vapor from the headspace of the receiving tank is warmed in the heat exchanger before traveling to the inlet of the compressor, said heat exchanger including a first passage and a second passage in heat exchange relationship with one another, said second passage having an inlet in fluid communication with the headspace of the receiving tank and an outlet in fluid communication with the inlet of the compressor and said first passage having an inlet in fluid communication with the outlet of the compressor and an outlet in fluid communication with the headspace of the dispensing tank, said heat exchanger configured so that vapor warmed by compression in the compressor travels through the first passage of the heat exchange and heats vapor flowing through the second passage of the heat exchanger.

7. The transfer system of claim 6 comprising a compressor bypass line selectively in fluid communication with the headspaces of the dispensing and receiving tanks for equalizing pressures of the dispensing and receiving tanks.

8. The transfer system of claim 6 further comprising an equalization line that selectively allows the vapor of the receiving tank to flow into the liquid space of the dispensing tank to keep overall system pressure from exceeding a predetermined level.

9. The transfer system of claim 6 further comprising a sensor configured to sense a liquid level within the dispensing tank, said sensor in communication with a controller that is configured to deactivate the compressor when a liquid level within the dispensing tank drops below a predetermined level.

10. The transfer system of claim 6 further comprising a sensor configured to sense a liquid level within the receiving tank, said sensor in communication with a controller that is configured to deactivate the compressor when a liquid level within the receiving tank exceeds a predetermined level.

11. A cryogenic fluid transfer system comprising:

a. a dispensing tank having a dispensing tank headspace, said dispensing tank configured to store a supply of cryogenic liquid with the dispensing tank headspace above the supply of cryogenic liquid;

b. a receiving tank having a receiving tank headspace;

c. a compressor having an inlet and an outlet;

d. a compressor inlet line in fluid communication with the receiving tank headspace and the compressor inlet;

e. a compressor outlet line in fluid communication with the compressor outlet and the headspace of the dispensing tank;

f. a liquid transfer line in fluid communication with the dispensing tank and the receiving tank and configured to transfer cryogenic liquid from the dispensing tank to the receiving tank when the compressor is activated so as to transfer vapor from the headspace of the receiving tank to the headspace of the dispensing tank to create a pressure differential between the dispensing and receiving tanks; and g. an equalization line that selectively allows the vapor of the receiving tank to flow into the liquid space of the dispensing tank to keep overall system pressure from exceeding a predetermined level.

12. The transfer system of claim 11 further comprising a heat exchanger having an inlet in fluid communication with the headspace of the receiving tank and an outlet in fluid communication with the inlet of the compressor, said heat exchanger configured so that vapor from the headspace of the receiving tank is warmed in the heat exchanger before traveling to the inlet of the compressor.

13. The transfer system of claim 11 further comprising a compressor bypass line selectively in fluid communication with the headspaces of the dispensing and receiving tanks for equalizing pressures of the dispensing and receiving tanks.

14. The transfer system of claim 11 further comprising a sensor configured to sense a liquid level within the dispensing tank, said sensor in communication with a controller that is configured to deactivate the compressor when a liquid level within the dispensing tank drops below a predetermined level.

15. The transfer system of claim 11 further comprising a sensor configured to sense a liquid level within the receiving tank, said sensor in communication with a controller that is configured to deactivate the compressor when a liquid level within the receiving tank exceeds a predetermined level.

16. A cryogenic fluid transfer system comprising:

a. a dispensing tank having a dispensing tank headspace, said dispensing tank configured to store a supply of cryogenic liquid with the dispensing tank headspace above the supply of cryogenic liquid;

b. a receiving tank having a receiving tank headspace;

c. a compressor having an inlet and an outlet;

d. a compressor inlet line in fluid communication with the receiving tank headspace and the compressor inlet;

e. a compressor outlet line in fluid communication with the compressor outlet and the headspace of the dispensing tank so that when the compressor is activated, vapor from the headspace of the receiving tank flows to the headspace of the dispensing tank so as to create a pressure differential between the dispensing and receiving tanks;

f. a liquid transfer line in fluid communication with the dispensing tank and the receiving tank and configured to transfer cryogenic liquid from the dispensing tank to the receiving tank due to the pressure differential between the dispensing and receiving tanks; and g. a compressor bypass line selectively in fluid communication with the headspaces of the dispensing and receiving tanks for equalizing pressures of the dispensing and receiving tanks.

17. The transfer system of claim 16 further comprising a heat exchanger having an inlet in fluid communication with the headspace of the receiving tank and an outlet in fluid communication with the inlet of the compressor, said heat exchanger configured so that vapor from the headspace of the receiving tank is warmed in the heat exchanger before traveling to the inlet of the compressor.

18. The transfer system of claim 17 wherein the heat exchanger is an ambient air heat exchanger.

19. The transfer system of claim 16 further comprising a sensor configured to sense a liquid level within the dispensing tank, said sensor in communication with a controller that is configured to deactivate the compressor when a liquid level within the dispensing tank drops below a predetermined level.

20. The transfer system of claim 16 further comprising a sensor configured to sense a liquid level within the receiving tank, said sensor in communication with a controller that is configured to deactivate the compressor when a liquid level within the receiving tank exceeds a predetermined level.

21. A cryogenic fluid transfer system comprising:

a. a dispensing tank having a dispensing tank headspace, said dispensing tank configured to store a supply of cryogenic liquid with the dispensing tank headspace above the supply of cryogenic liquid;

b. a receiving tank having a receiving tank headspace;

c. a compressor having an inlet and an outlet;

d. a compressor inlet line in fluid communication with the receiving tank headspace and the compressor inlet;

e. a compressor outlet line in fluid communication with the compressor outlet and the headspace of the dispensing tank so that when the compressor is activated, vapor from the headspace of the receiving tank flows to the headspace of the dispensing tank so as to create a pressure differential between the dispensing and receiving tanks;

f. a liquid transfer line in fluid communication with the dispensing tank and the receiving tank and configured to transfer cryogenic liquid from the dispensing tank to the receiving tank due to the pressure differential between the dispensing and receiving tanks; and g. a heat exchanger configured so that vapor from the headspace of the receiving tank is warmed in the heat exchanger before traveling to the inlet of the compressor, said heat exchanger including a first passage and a second passage in heat exchange relationship with one another, said second passage having an inlet in fluid communication with the headspace of the receiving tank and an outlet in fluid communication with the inlet of the compressor and said first passage having an inlet in fluid communication with the outlet of the compressor and an outlet in fluid communication with the headspace of the dispensing tank, said heat exchanger configured so that vapor warmed by compression in the compressor travels through the first passage of the heat exchange and heats vapor flowing through the second passage of the heat exchanger.

22. The transfer system of claim 21 further comprising a compressor bypass line selectively in fluid communication with the headspaces of the dispensing and receiving tanks for equalizing pressures of the dispensing and receiving tanks.

23. A cryogenic fluid transfer system comprising:

a. a dispensing tank having a dispensing tank headspace, said dispensing tank configured to store a supply of cryogenic liquid with the dispensing tank headspace above the supply of cryogenic liquid;

b. a receiving tank having a receiving tank headspace;

c. a compressor having an inlet and an outlet;

d. a compressor inlet line in fluid communication with the receiving tank headspace and the compressor inlet;

e. a compressor outlet line in fluid communication with the compressor outlet and the headspace of the dispensing tank so that when the compressor is activated, vapor from the headspace of the receiving tank flows to the headspace of the dispensing tank so as to create a pressure differential between the dispensing and receiving tanks;

f. a liquid transfer line in fluid communication with the dispensing tank and the receiving tank and configured to transfer cryogenic liquid from the dispensing tank to the receiving tank due to the pressure differential between the dispensing and receiving tanks; and g. an equalization line that allows the vapor of the receiving tank to flow into the liquid space of the dispensing tank to keep overall system pressure from exceeding a predetermined level.

* * * * *